United States Patent [19]

Morita et al.

[11] Patent Number: 5,058,285

[45] Date of Patent: Oct. 22, 1991

[54] TEMPLATE

[75] Inventors: Shiro Morita, Sakura; Kazuo Yoshitake, Tokyo, both of Japan

[73] Assignee: Yoshitake Seisakujo Co., Inc., Tokyo, Japan

[21] Appl. No.: 553,662

[22] Filed: Jul. 18, 1990

[30] Foreign Application Priority Data

Jul. 18, 1989 [JP] Japan ..... 1-83616

[51] Int. Cl.[5] ..... B43I 13/20

[52] U.S. Cl. ..... 33/563; 33/565; 33/447; 33/450

[58] Field of Search ..... 33/1 B, 562, 563, 564, 33/565, 566, 447, 450, 27.01, 1 G, 11 K; 434/85, 87

[56] References Cited

U.S. PATENT DOCUMENTS 3,633,286 1/1972 Maurer ..... 33/563 X

FOREIGN PATENT DOCUMENTS 2919874 11/1980 Fed. Rep. of Germany ..... 33/563

*Primary Examiner*—Harry N. Haroian

*Attorney, Agent, or Firm*—Staas & Halsey

[57] ABSTRACT

A template includes a reference panel for bringing the center of a figure to be drawn into exact alignment with the center of a previously drawn figure. The reference panel, when used in combination with a figure panel having figure holes, allows concentric figures to be drawn accurately.

6 Claims, 1 Drawing Sheet

TEMPLATE

BACKGROUND OF THE INVENTION

1. Field of the Invention

The present invention relates to a template for drawing a plurality of concentric figures, and more particularly to a template for drawing similar figures concentrically.

2. Description of the Prior Art

Templates for use in drawing figures are normally in the form of a thin plastic panel having differently shaped and sized holes defined therein. When a certain figure is to be drawn using a template, the edge of a corresponding hole of the template is followed with a pencil, a pen, or the like which is being pressed against a drawing sheet. Such templates are useful in drawing various figures such as computer program flowchart symbols, circles, ellipses, triangles, squares, and other shapes, exactly alike, without making actual dimensional measurements.

Conventional templates typically have horizontal reference lines inscribed thereon on lateral sides of each hole so that a figure to be drawn can be positioned with respect to a certain frame, and also vertical reference lines inscribed thereon on upper and lower sides of each hole. When a figure is to be drawn in a given position on a graph paper sheet, the horizontal reference lines on the lateral sides of a desired hole in the template are held in alignment with one of the horizontal lines on the graph paper sheet, and then the vertical reference lines on the upper and lower sides of the hole are aligned with one of the vertical lines on the graph paper sheet. Thereafter, the inner edge of the hole is traced with a pencil, a pen, or the like.

When a next figure, which is similar to the figure thus drawn, is to be drawn concentrically therewith, the horizontal reference lines on the, lateral sides of a template hole corresponding to the next figure are aligned with the previously selected horizontal line on the graph paper sheet, and the vertical reference lines on the upper and lower sides of the next figure hole are brought into alignment with the previously selected vertical line on the graph paper sheet. Then, the next figure is drawn inside or outside of the previously drawn figure while following the edge of the next figure hole in the template.

The horizontal and vertical reference lines inscribed on the conventional templates are relatively short. Figures may not be drawn accurately, using the conventional templates, because of an optical illusion caused by the thickness of the templates and shadows produced by the templates under illuminating light applied obliquely thereto. Therefore, a considerable degree of caution and skill is required on the part of the draftsman in order to align the reference lines on the templates with given lines on graph paper sheets.

Double concentric circles are to be drawn with a spacing of 0.5 mm, for example. If the centers of these two circles are positionally diplaced from each other by 0.2 mm because the draftsman is not careful or skillful enough, then the two circles are spaced from each other by 0.3 mm at minimum and 0.7 mm at maximum, and hence cannot be acceptable as properly drawn double concentric circles.

SUMMARY OF THE INVENTION

It is a major object of the present invention to provide a template which allows even an unskilled draftsman to draw a plurality of similar figures concentrically with ease.

Another object of the present invention is to provide a template which is not drastically different in structure from conventional templates but is capable of drawing a plurality of concentric figures.

To achieve the above objects, there is provided in accordance with the present invention a template comprising a figure panel having at least one straight edge extending on a pereiphery thereof and a plurality of figure holes defined therein and having respective centers positioned on a first imaginary line parallel to the straight edge, the figure panel having first positioning means disposed in positions where second imaginary lines which pass through the centers of the figure holes and extend perpendicularly to the first imaginary line cross the straight edge, and a reference panel having at least one straight edge extending on a periphery thereof for contact with the straight edge of the figure panel, and second positioning means disposed on the straight edge of the reference panel for interfitting engagement with the first positioning means to determine a postion to draw a figure with one of the figure holes.

Using the template thus constructed, concentric figures can be drawn easily without special skill, and accurately and quickly without great care. Furthermore, the template of the present invention can simply be handled even by a layman since it is not drastically different in structure from conventional templates.

The above and other objects, features and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 1:
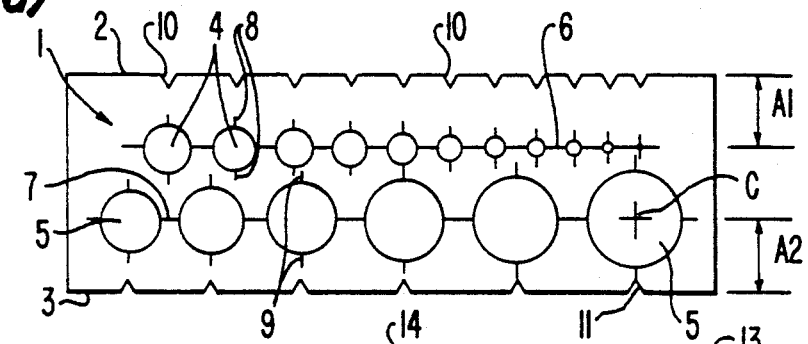
FIGS. 1(*a*) and 1(*b*) are a front elevational view of a template for drawing figures according to an embodiment of the present invention, the template comprising a figure panel and a reference panel.
Figure 1:
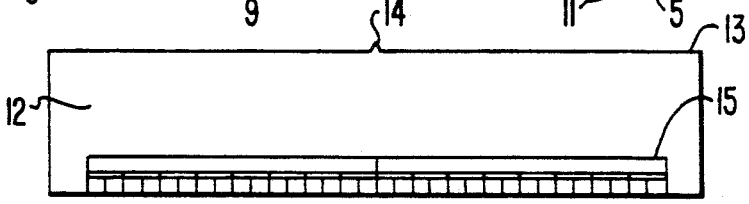

As shown in FIGS. 1(*a*) and 1(*b*), a template for drawing figures according to an embodiment of the present invention includes a figure panel 1. The figure panel 1 of FIG. 1(*a*) comprises a thin transparent or semitransparent panel of plastic and has upper and lower straight edges 2, 3. The figure panel 1 has a horizontal row or array of circular holes 4 defined therein along the upper edge 2. The circular holes 4 are successively arranged such that their diameters are progressively smaller to the right in FIG. 1(*a*). The circular holes 4 are positioned on an imaginary straight line (not shown) parallel to the upper edge 2, and have respective centers on such an imaginary straight line. The figure panel 1 also has a horizontal array of circular holes 5 defined therein along the lower edge 3. The circular holes 5 are successively arranged such that they diameters are progressively smaller to the left in FIG. 1(*a*). The circular holes 5 are positioned on an imaginary straight line (not shown) parallell to the lower edge 3, and have respective centers on such an imaginary straight line. The imaginary straight line parallel to the upper edge 2 is spaced from the upper edge 2 by a distance A1 which is equal to the distance A2 by which the imaginary straight line parellel to the lower edge 3 is spaced from the lower edge 3. On the reverse side of the figure panel 1, there are printed horizontal reference lines 6, 7 along the above two imaginary straight lines. Vertical reference lines 8 are also printed on the reverse side of the figure panel 1, the vertical reference lines 8 being positioned on upper and lower sides of the circular holes 4, which are located on an upper side of the figure panel 1. Similarly, vertical reference lines 9 are printed on the reverse side of the figure panel 1, the vertical reference lines 8 being positioned on upper and lower sides of the circular holes 5 which are located on a lower side of the figure panel 1. The centers of the circular holes 4, 5 are postioned on points of intersection between imaginary lines interconnecting the printed vertical lines 8, 9 and the imaginary lines lying parallel to the upper and lower edges 2, 3.

The greatest circular hole in the lower rightmost corner of the figure plate 1(*a*) has a center C as shown in FIG. 1.

The figure panel 1 has an array of triangular fitting grooves 10 which are defined in the upper edge 2 where extensions of the vertical reference lines 8 on the upper and lower sides of the circular holes 4 intersect with the upper edge 2 of the figure panel 1. The figure panel 1 also has an array of triangular fitting grooves 11 which are defined in the lower edge 3 where extensions of the vertical reference lines 9 on the upper and lower sides of the circular holes 5 intersect with the lower edge 3 of the figure panel 1. The triangular fitting grooves 10, 11 are of the same size as each other.

The template shown in FIGS. 1(*a*) and 1(*b*) also includes a reference panel 12 for setting reference positions when concentric figures are to be drawn. The reference panel 12 of FIG. 1(*b*) is in the form of a thin panel of plastic which has the same thickness as that of the figure panel 1, and an upper straight edge 13. The upper panel 13 has a substantially central triangular ridge 14 which can fit in any one of the fitting grooves 10, 11 of the figure panel 1. The reference panel 12 has dimensional graduations 15 on its lower edge so that the reference panel 12 can be used as a rule.

Operation of the template thus constructed will be described below.

The horizontal line 6 or 7 on the lateral sides of a desired one of the circular holes 4, 5 is first brought into alignment with a horizontal reference line on a graph paper sheet, and then the vertical line 8 or 9 on the upper and lower sides of the desired circular hole is aligned with a vertical reference line on the graph paper sheet. Then, a circle is drawn on the graph paper sheet along the inner edge of the desired circular hole. After the circle has been drawn, the figure panel 1 is maintained in its position without being moved, and the upper edge 13 of the reference panel 1 is held against one of the upper and lower edges 2, 3 which is near the circular hole that has been traced to draw the circle. At the same time, the ridge 14 of the reference panel 12 is fitted into one of the fitting grooves which is positioned on the vertical reference line of the circular hole that has been used to draw the circle.

Then, while holding the reference panel 12 against movement, the figure panel 1 is moved to select a circular hole for a next circle to be drawn, and the fitting groove on the vertical reference line of the selected circular hole is fitted over the ridge 14 of the reference panel 12. At this time, the center of the previously drawn circle coincides with the center of the circle to be drawn this time. If the next circle is drawn at this time, two similar concentric circles can be drawn.

Figure 2:
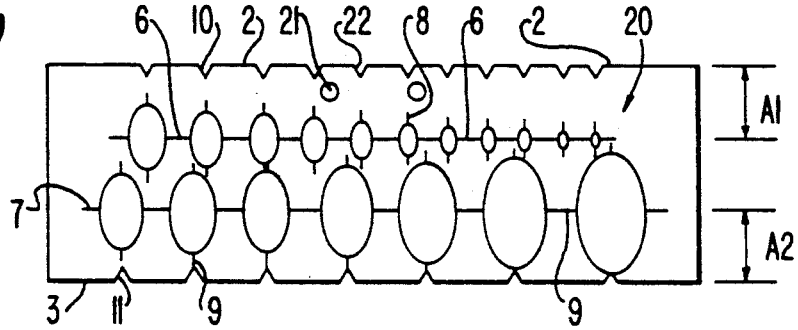
FIGS. 2(*a*) and 2(*b*) are a front elevational view of a template for drawing figures according to another embodiment of the present invention, the template comprising figure panels, one of which doubles as a reference panel.
Figure 2:
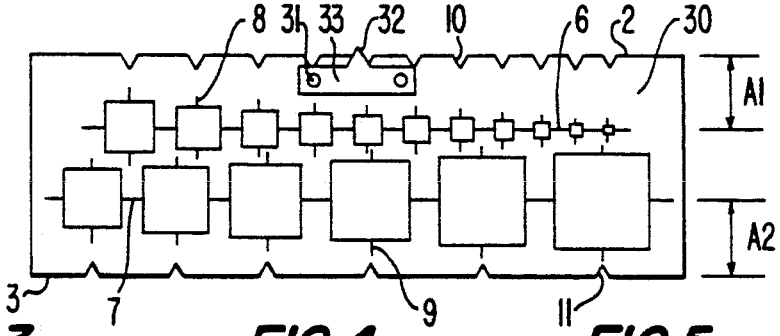

FIGS. 2(*a*) and 2(*b*) show a template according to another embodiment of the present invention. The template shown in FIGS. 2(*a*) and 2(*b*) comprises two figure panels, one used as a figure panel and one as a reference panel. The figure panel, generally denoted at 20 in FIG. 2(*a*), which is used as a figure panel for drawing ellipses, has two through holes 21, 22 defined therein near an upper edge 2 thereof. The figure panel 20 also has a plurality of elliptical holes positioned in the same manner as the circular holes 4, 5 in the figure panel 1 shown in FIG. 1(*a*). The other structural details of the figure panel 20 are identical to those of the figure panel 1, and those parts of the figure panel 20 which are identical to those of the figure panel 1 are denoted by identical reference numerals and will not be described in detail.

The figure panel, generally denoted at 30 in FIG. 2(*b*) which doubles as a reference panel, is used to draw squares. The figure panel 30 has two circular through holes 31, 32 defined therein near an upper edge 2 thereof. These through holes 31, 32 are in the same relative position as the through holes 21, 22 in the figure panel 20. The figure panel 30 also has a pluraliity of square holes positioned in the same manner as the elliptical holes in the figure panel 20. A reference piece 33 is detachably mounted on the figure panel 30 and positioned at the through holes 31, 32. The other structural details of the figure panel 30 are identical to those of the figure panel 20, and those parts of the figure panel 30 which are identical to those of the figure panel 20 are denoted by identical reference numerals and will not be described in detail.

Figure 3:
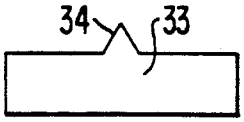
FIG. 3 is a top view of a reference piece of the template shown in FIG. 2.
Figure 4:
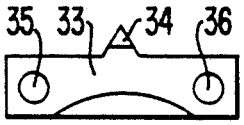
FIG. 4 is a bottom view of the reference piece.
Figure 5:
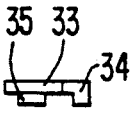
FIG. 5 is a side elevational view of the reference piece.

As better shown in FIG. 3, the reference piece 33 has a triangular fitting ridge 34 on an upper edge thereof. When the reference piece 33 is attached to the figure panel 30, the fitting ridge 34 projects from the upper edge 2 by the same distance as that by which the ridge 14 of the reference panel 12 (FIG. 1(*b*) projects. As shown in FIGS. 4 and 5, the reference piece 33 has on its reverse side two circular projections 35, 36 which snugly fit in the respective through holes 31, 32 when the reference piece 33 is attached to the figure panel 30.

To draw elliptical figures concentrically with each other, the figure panel 20 is used as a figure panel, and the figure panel 30 is used as a reference panel with the reference piece 33 fixed thereto. To draw square figures concentrically with each other, the reference piece 33 is detached from the figure panel 30, and then attached to the figure panel 20, so that the figure panel 30 is used as a figure panel whereas the figure panel 20 is used as a reference panel.

In the illustrated embodiments, the fitting ridges and the grooves which receive the fitting ridges are triangular in shape. However, the fitting ridges and grooves are not limited to the triangular shape, but may be semicircular or square or rectangular in shape. Fitting ridges may be provided on the figure panels and a groove for receiving the fitting ridges may be defined in the reference panel or piece.

A plurality of figure panels having circular, elliptical, square, rectangular, and other shaped holes for drawing various different figures may be employed insofar as the distance A1 between the upper edge 2 and the imaginary straight line passing through the centers of holes in one row and the distance A2 between the lower edge 3 and the imaginary straight line passing through the center of holes in another row are the same as each other on each of the figure panels. Also the distances A1, A2 on all the figure panels are the same as each other. The template of such an arrangement allows the draftsman to draw various different figures accurately concentrically, with each other.

Although certain preferred embodiments have been shown and described, it should be understood that many changes and modifications may be made therein without departing from the scope of the appended claims

We claim:

1. A template comprising:

a figure panel having at least one straight edge extending on a periphery thereof and a plurality of figure holes defined therein and having respective centers positioned on a first imaginary line parallel to said straight edge, said figure panel having first positioning means disposed in positions where second imgaginary lines which pass through the centers of said figure holes and extend perpendicularly to said first imaginary line cross said straight edge;

a reference panel having at least one straight edge extending on a periphery thereof for contact with said straight edge of the figure panel;

and second positioning means disposed on said straight edge of the reference panel for interfitting engagement with said first positioning means to determine a position to draw a figure with one of said figure holes, said second positioning means being detachably mounted on said straight edge of the reference panel.

2. A template according to claim 1, wherein said reference panel has dimensional graduations.

3. A template according to claim 1, wherein said reference panel is substantially identical in shape to said figure panel.

4. A template according to claim 1, wherein one of said positioning means comprises a protruding ridge and the other of said positioning means comprises a groove having the same cross-sectional configuration as said ridge.

5. A template according to claim 1, wherein said second positioning means is a separate reference piece and means are provided on said reference panel for detachably mounting said reference piece.

6. A template according to claim 1, wherein both of said panels have at least one straight edge extending on a periphery thereof and a plurality of figure holes defined therein and have respective centers positioned on a first imaginary line parallel to said straight edge; both of said panels having first positioning means disposed in postions where second imaginary lines which pass through the centers of said figure holes and extend perpendicularly to said first imaginary line cross said straight edge; said second positioning means is a separate reference piece and both said panels are provided with means for detachably mounting said reference piece whereby either of said panels may be used as a figure panel or a reference panel.

* * * * *

UNITED STATES PATENT AND TRADEMARK OFFICE

CERTIFICATE OF CORRECTION

PATENT NO. : 5,058,285

DATED : October 22, 1991

INVENTOR(S) : SHIRO MORITA, KAZUO YOSHITAKE

It is certified that error appears in the above-identified patent and that said Letters Patent is hereby corrected as shown below:

Column 1, line 63, "diplaced" should be --displaced--.

Column 2, line 26, "postion" should be --position--.

Column 3, line 6 "they" should be --the--;

line 31, after "hole" insert --5--;

line 32, "1(a) should be --1--;

line 33, "1" should be --1(a)--;

line 51, "panel" should be --straight edge--.

Column 5, line 37, "imgaginary" should be --imaginary--.

Signed and Sealed this

Thirteenth Day of April, 1993

*Attest:*

STEPHEN G. KUNIN

*Attesting Officer*

*Acting Commissioner of Patents and Trademarks*